US008062511B2

(12) United States Patent
Spence et al.

(10) Patent No.: US 8,062,511 B2
(45) Date of Patent: Nov. 22, 2011

(54) PRIMARY FROTH RECYCLE

(75) Inventors: Jonathan Spence, Edmonton (CA); Teddy Kwong, Edmonton (CA); Kamal Hammad, Fort McMurray (CA); Samson Ng, Sherwood Park (CA); Robert Siy, Edmonton (CA); Jason Schaan, Edmonton (CA)

(73) Assignee: Syncrude Canada Ltd., Fort McMurray (CA)

( * ) Notice: Subject to any disclaimer, the term of this patent is extended or adjusted under 35 U.S.C. 154(b) by 499 days.

(21) Appl. No.: 12/163,590

(22) Filed: Jun. 27, 2008

(65) Prior Publication Data

US 2009/0321326 A1 Dec. 31, 2009

(51) Int. Cl.
*C10G 1/04* (2006.01)

(52) U.S. Cl. ..... 208/390; 208/391

(58) Field of Classification Search ..... 208/390, 208/391

See application file for complete search history.

(56) References Cited

U.S. PATENT DOCUMENTS

| | | | | |
|---|---|---|---|---|
| 4,116,809 | A | 9/1978 | Kizior | |
| 4,776,949 | A * | 10/1988 | Leung et al. | 208/390 |
| 5,039,227 | A | 8/1991 | Leung et al. | |
| 5,264,118 | A | 11/1993 | Cymerman et al. | |
| 6,007,708 | A | 12/1999 | Allcock et al. | |
| 2006/0249431 | A1 * | 11/2006 | Cymerman et al. | 208/391 |

FOREIGN PATENT DOCUMENTS

| | | |
|---|---|---|
| CA | 2029795 | 5/1991 |
| CA | 2195604 | 7/1998 |
| CA | 2217623 | 4/1999 |
| CA | 2263858 | 2/2000 |
| CA | 2480122 | 1/2006 |

* cited by examiner

*Primary Examiner* — Glenn Caldarola
*Assistant Examiner* — Michelle Stein
(74) *Attorney, Agent, or Firm* — Bennett Jones LLP

(57) ABSTRACT

A process for extracting bitumen from oil sand, comprising: mixing oil sand with process water to produce an oil sand slurry containing bitumen, sand, water and entrained air; conditioning the oil sand slurry; optionally flooding the conditioned oil sand slurry with flood water to dilute the slurry, if required; introducing the slurry into a primary separation vessel wherein separate layers of primary bitumen froth, middlings and sand tailings are formed; removing a portion of the primary bitumen froth from the primary separation vessel and recycling the portion of primary bitumen froth to that step of the process upstream of the primary separation vessel to join and mix with the feed stream moving to the primary separation vessel; and thereafter retaining said feed stream in said primary separation vessel to produce primary bitumen froth.

18 Claims, 5 Drawing Sheets

PRIMARY FROTH RECYCLE

The present invention relates generally to a method for improving the recovery of bitumen in an oil sand extraction process by recycling a portion of primary bitumen froth produced in a primary separation vessel to a location upstream of the primary separation vessel. In one embodiment, the portion of primary bitumen froth is deaerated prior to upstream recycling.

BACKGROUND OF THE INVENTION

Oil sand, such as is mined in the Fort McMurray region of Alberta, generally comprises water-wet sand grains held together by a matrix of viscous bitumen. It lends itself to liberation of the sand grains from the bitumen by mixing or slurrying the oil sand in water, allowing the bitumen to move to the aqueous phase.

For many years, the bitumen in the McMurray sand has been commercially removed from oil sand using what is commonly referred to in the industry as the "hot water process", whereby as-mined oil sand is mixed in a rotating tumbler for a prescribed retention time (generally in the range of 2 to 4 minutes) with hot water (approximately 80-90° C.), steam, caustic (e.g., sodium hydroxide) and naturally entrained air to yield a slurry that has a temperature typically around 80° C. The bitumen matrix is heated and becomes less viscous. Chunks of oil sand are ablated or disintegrated. The released sand grains and separated bitumen flecks are dispersed in the water. To some extent bitumen flecks coalesce and grow in size. They may contact air bubbles and coat them to become aerated bitumen. The term used to describe this overall process in the tumbler is "conditioning". The slurry is then diluted with additional hot water to produce a diluted slurry having a temperature of about 65° C. to about 80° C. The diluted slurry is introduced into a large, open-topped, conical-bottomed, cylindrical vessel commonly termed a primary separation vessel (PSV) where the more buoyant aerated bitumen rises to the surface and forms a bitumen froth layer. This froth layer overflows the top lip of the PSV and is received in a launder extending around the PSV's rim. The product is commonly called "primary bitumen froth" and typically has a temperature of about 65° C. to about 75° C.

In the early 1990s, there was a major innovation in the oil sand industry, which is commonly referred to as "pipeline conditioning". This innovation is disclosed in Canadian Patent No. 2,029,795 and U.S. Pat. No. 5,264,118. As-mined oil sand is mixed at the mine site (for example, in a cyclofeeder) with hot water, air and NaOH to produce a slurry. The slurry is pumped through a pipeline at least about 2.5 kilometres in length and is fed directly to a conventional gravity separation vessel such as a PSV. In the course of being pumped through the pipeline, sufficient coalescence and aeration of bitumen occurs so that, when subsequently retained in the vessel under quiescent conditions, a desirable amount of the bitumen floats, forms froth, and is recovered.

In the late 1990s a cold dense slurrying process for extracting bitumen from oil sand was developed, which is disclosed in Canadian patent No. 2,217,623 and U.S. Pat. No. 6,007,708. This process is commonly referred to as the "low energy extraction process" or the "LEE process" and generally comprises mixing as-mined oil sand with water in predetermined proportions near the mine site to produce a slurry containing entrained air and having a controlled density in the range of 1.4 to 1.65 g/cc and preferably a temperature in the range 20-40° C.; pumping the slurry through a pipeline having a plurality of pumps spaced along its length, preferably adding air to the slurry as it moves through the pipeline, to condition the slurry; diluting the slurry with flood water; and introducing the diluted slurry into a conventional gravity separation vessel such as a PSV to float the aerated bitumen. The froth is maintained at a temperature of at least 35° C. in the PSV by use of a warm water underwash, thereby assisting in removing the froth from the PSV and satisfying downstream froth temperature needs. A middlings layer and tailings layer are also formed in the PSV. A stream of middlings may be continuously withdrawn and further bitumen recovered in a secondary recovery circuit, for example, mechanical flotation cells. The secondary bitumen froth so produced may either be combined with the primary bitumen froth or recycled and added to the fresh slurry being introduced to the primary separation to increase bitumen recovery as primary froth, as described in U.S. Pat. No. 4,776,949.

SUMMARY OF THE INVENTION

It was surprisingly discovered that recycling a portion of the primary bitumen froth produced in a conventional gravity separation vessel such as a PSV to a location upstream of the vessel resulted in greater overall bitumen recovery and, more particularly, better recovery of bitumen in the primary froth and higher quality primary froth.

Thus, in one aspect of the present application, a process is provided for extracting bitumen from oil sand, comprising:

- mixing oil sand with process water to produce an oil sand slurry containing bitumen, sand, water and entrained air;
- conditioning the oil sand slurry;
- optionally flooding the conditioned oil sand slurry with flood water to dilute the slurry if required;
- introducing the slurry into a primary separation vessel wherein separate layers of primary bitumen froth, middlings and sand tailings are formed;
- removing a portion of the primary bitumen froth from the primary separation vessel and recycling the portion of primary bitumen froth to that step of the process upstream of the primary separation vessel to join and mix with the feed stream moving to the primary separation vessel; and
- thereafter retaining said feed stream in said primary separation vessel to produce primary bitumen froth.

In one embodiment, the process further comprises deaerating the portion of primary bitumen froth removed from the primary separation vessel prior to upstream recycling.

By "conditioning" is meant digestion of oil sand lumps, liberation of bitumen from sand-fines-bitumen matrix, coalescence of liberated bitumen flecks into larger bitumen droplets and aeration of bitumen droplets. It is understood that such conditioning can occur by agitating the oil sand slurry in a conventional rotating tumbler or agitation tank for a sufficient period of time or by preparing the oil sand slurry in a slurry preparation unit and then pumping the oil sand slurry through a pipeline of sufficient length (e.g., typically greater than about 2.5 km).

By "deaerating" is meant removing a portion of the air present in the primary bitumen froth by any means known in the art, for example, using deaerator columns or other mechanical deaeration processes and/or heating deaeration processes, to give deaerated primary bitumen froth generally having an air content of less than about 20 volume %.

It is understood the quality of mined oil sand varies greatly in both the bitumen content and the fines content (solids having a size less about 44 μm). For example, a "low grade" oil sand typically will contain between about 6 to 10 wt. % bitumen and greater than about 25 wt. % fines. An "average grade" oil sand will typically contain at least 10 wt. % bitumen to about 12.0 wt. % bitumen with about 15 to 25 wt. % fines and a "high grade" oil sand will typically contain greater than 12.5 wt. % bitumen with less than 15 wt. % fines. The grade of oil sand used in extraction processes has very significant effects on the completeness of bitumen recovery in the PSV and the quality of the bitumen froth.

The temperature of the water used in the present invention for forming oil sand slurry can range from anywhere between about 20° C. (as used in the LEE process) to about 95° C. (as used in the hot water process). It was discovered that improvement in bitumen recovery by bitumen froth recycling was greatest when processing low to average grade oil sand.

In one embodiment, the oil sand slurry is predominantly conditioned in a conditioning pipeline and the portion of the primary bitumen froth from the PSV or deaerated primary bitumen froth is recycled to a mix tank or pump box located upstream of the conditioning pipeline and mixed with the oil sand slurry prior to pipeline conditioning. In another embodiment, the portion of primary bitumen froth from the PSV or deaerated primary bitumen froth can be injected into the conditioning pipeline at one or more points along the conditioning pipeline. In another embodiment, the portion of primary bitumen froth from the PSV or deaerated primary bitumen froth is recycled upstream of the primary separation vessel but downstream of the conditioning pipeline. In another embodiment, the portion of primary bitumen froth from the PSV or deaerated primary bitumen froth is recycled to the slurry preparation unit where the oil sand is first mixed with water to form the oil sand slurry. In one embodiment, where both oil sand and water mixing and slurry conditioning takes place in the slurry preparation unit itself, as is the case when using a rotating tumbler during the hot water extraction process, the portion of primary bitumen froth from the PSV or deaerated primary bitumen froth is added directly to the rotating tumbler.

Flood water may be added after slurry preparation and conditioning if the oil sand slurry is too dense, meaning it is substantially greater than 1.5 g/cc, to give a slurry having a density of about 1.4 g/cc to about 1.5 g/cc.

In one embodiment, the portion of primary bitumen froth recycled either directly from the PSV or after deaeration is at least between about 10% to about 50% of the froth produced in the primary separation vessel.

Other features will become apparent from the following detailed description. It should be understood, however, that the detailed description and the specific embodiments, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

The invention is exemplified by the following description and examples.

Figure 1A:
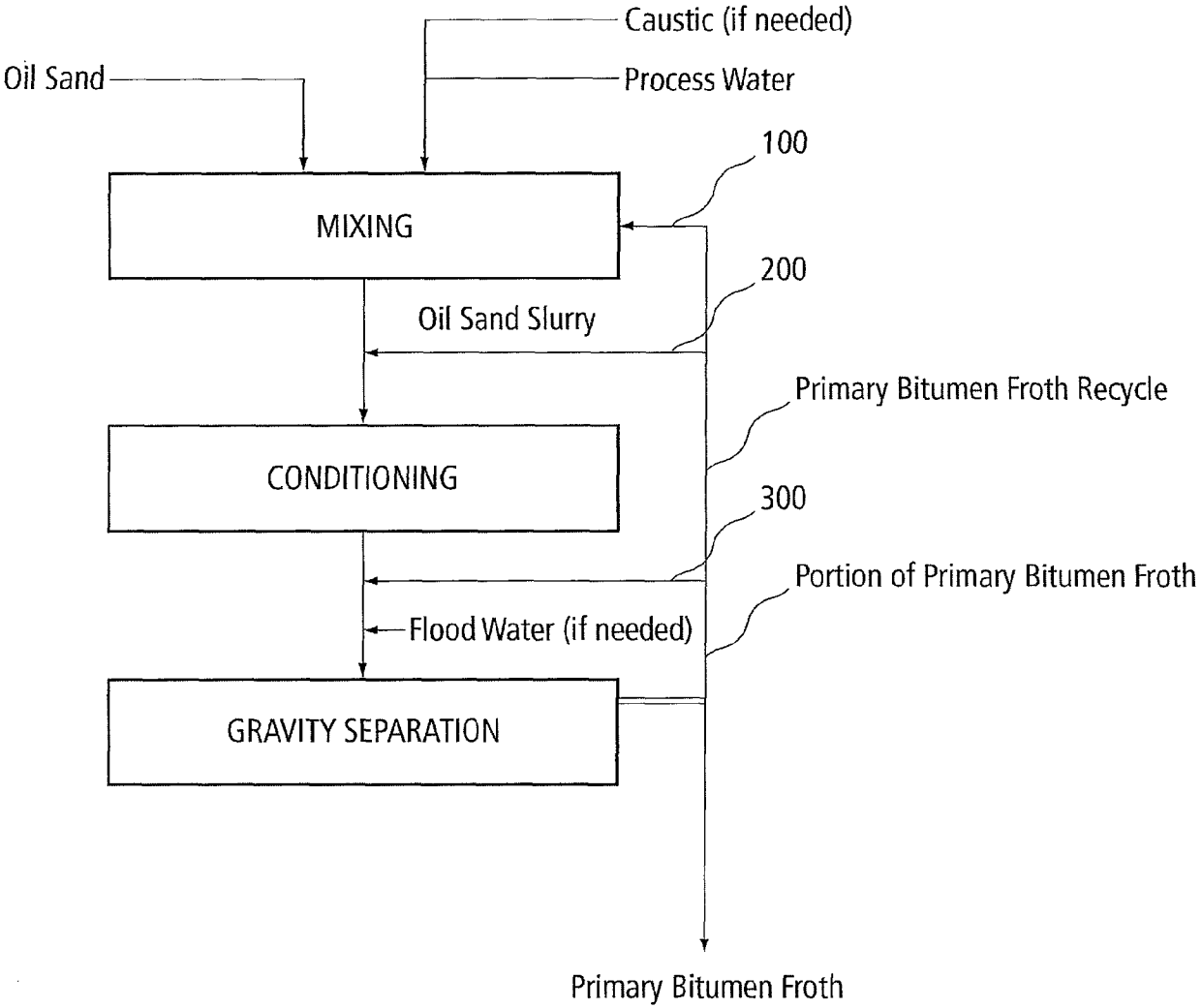
FIG. 1*a* is a block diagram setting forth the process in accordance with one aspect of the invention where primary bitumen froth is recycled upstream of the gravity separation step.

FIG. 1*a* is a block diagram setting forth the process in accordance with one aspect of the invention. Mined oil sand is mixed with process water ranging in temperature from anywhere from about 95° C. to about 20° C., as is known in the art. Optionally, NaOH (caustic) may be added to the process water. The oil sand and process water is mixed in a slurry preparation system to produce oil sand slurry. Oil sand slurry is then conditioned, for example, by pumping it through a pipeline of sufficient length, generally 3 km or longer. The oil sand slurry is generally first contained in a mixing or pump box prior to being pumped through the conditioning pipeline.

The now conditioned oil sand slurry may be further diluted with flood water, if needed, to ensure the proper density of the slurry, e.g., approximately 1.4 g/cc to 1.5 g/cc, and, optionally, further aerated, prior to being fed into a quiescent gravity separation vessel commonly referred to in the industry as a primary separation vessel. In the primary separation vessel, separate layers of primary bitumen froth, middlings and sand tailings are formed.

A portion of the primary bitumen froth produced in the primary separation vessel, said portion in one embodiment ranging anywhere from about 10% to about 50%, is continuously removed and may be recycled upstream of the primary separation vessel, for example, to be mixed with the oil sand slurry prior to pipeline conditioning (bitumen froth stream 200). The portion of primary bitumen froth can be added, for example, to a pump box used to feed the oil sand slurry into the conditioning pipeline. It is understood, however, less than 10% of the primary froth can be recycled with less pronounced improvement in overall bitumen recovery. Further, it is understood that greater than 50% of the primary froth can be recycled, however, froth quality may start to decrease.

In another embodiment, the portion of primary bitumen froth can be added at the mixing step (bitumen froth stream 100), for example, to a slurry preparation unit such as a mixer circuit in the form of a vertically oriented stack of components, which functions to slurry oil sand with water in preparation for pumping through a conditioning pipeline, as disclosed in Canadian Patent No. 2,195,604. In another embodiment, the oil sand slurry preparation unit may both prepare the oil sand slurry and condition the slurry at the same time. For example, a rotary tumbler could be used as described in U.S. Pat. No. 4,776,949, which tumbler is generally used during the hot water process, and in this case oil sand slurry conditioning may take place entirely in the rotary tumbler so that pipeline conditioning is not needed. In this embodiment, the portion of primary bitumen froth can be added directly to the rotary tumbler (bitumen froth stream 100).

In another embodiment, the portion of primary bitumen froth can be added after the conditioning step but prior to the gravity separation step (bitumen froth stream 300). In this embodiment, the portion of primary bitumen froth can be added either before or after the addition of flood water and/or air.

Figure 1B:
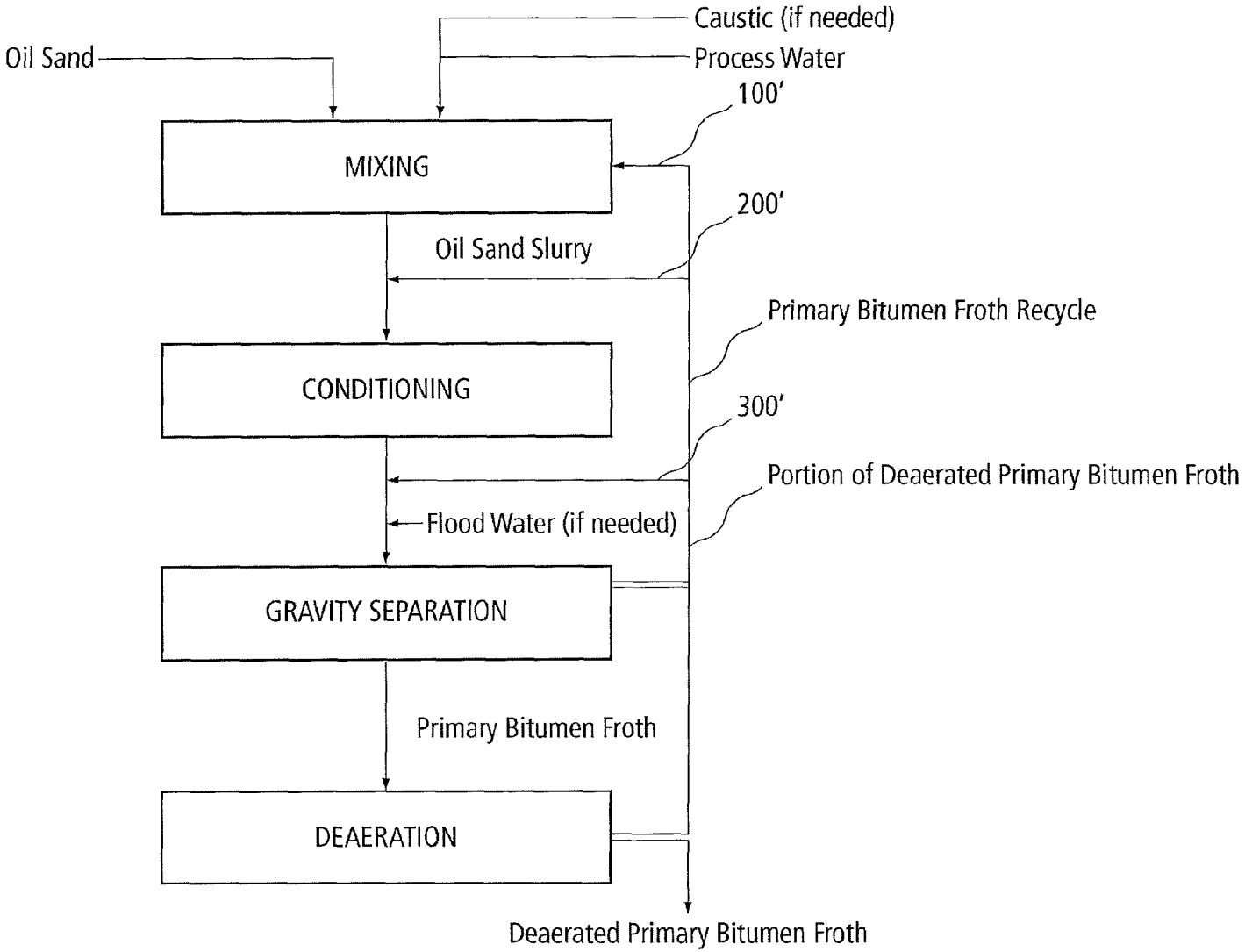
FIG. 1*b* is a block diagram setting forth the process in accordance with one aspect of the invention where deaerated primary bitumen froth is recycled upstream of the gravity separation step.

In another aspect of the invention, which is shown in block diagram FIG. 1*b*, the primary bitumen froth (or a portion thereof) is first deaerated in a deaerator as known in the art prior to being recycled upstream of the primary gravity separation step. One example of a deaeration process which can be used to deaerate the primary bitumen is taught in U.S. Pat. No. 4,116,809, incorporated herein by reference. Another example of a suitable deaeration process, mechanical deaeration, is disclosed in Canadian Patent No. 2,263,858, incorporated herein by reference. Thus, a portion of deaerated bitumen froth can be added at the mixing step (deaerated bitumen froth stream 100'), after the mixing step but prior to conditioning (deaerated bitumen froth stream 200') or prior to addition of conditioned slurry into the primary separation vessel for gravity separation (deaerated bitumen froth stream 300').

Figure 2:
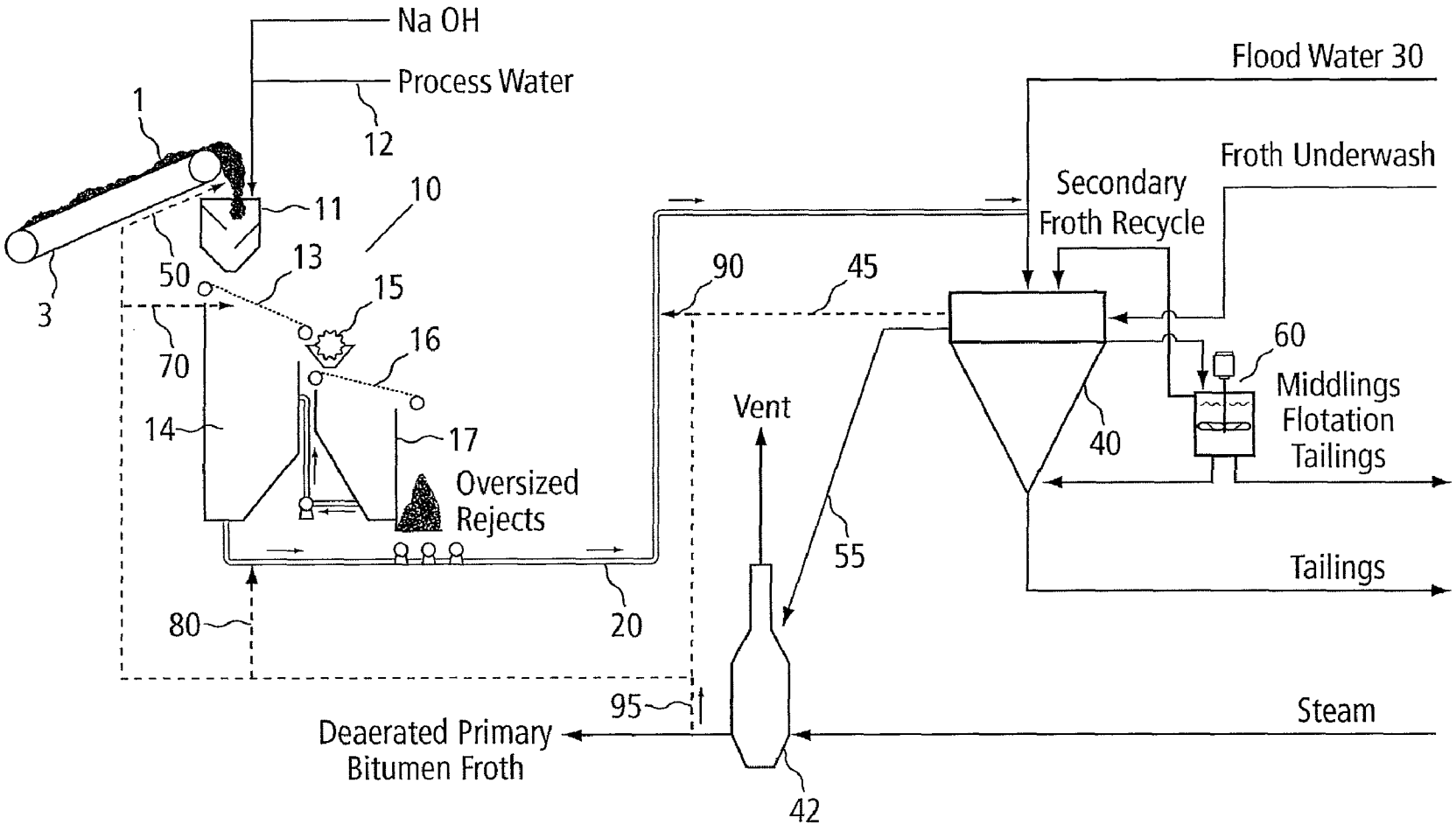
FIG. 2 is a schematic of an industrial scale system for practicing the process.

FIG. 2 shows an example of one possible commercial operation using primary bitumen froth recycle. Crushed oil sand 1 is continuously conveyed via conveyer 3 to an oil sand slurry preparation system 10. In this embodiment, the oil sand slurry preparation system 10 comprises mix box 11 having a plurality of baffles where the oil sand 1 is mixed with process water 12 and, optionally, NaOH (caustic). The slurry formed in mix box 11 is then dropped through vibrating screen 13 into pump box 14. Oversize is crushed in crusher 15 and drops through secondary vibrating screen 16 into a second pump box 17. In the alternative, the oil sand preparation system 10 can be replaced with a compact slurry preparation system as described in Canadian Patent Application No. 2,480,122, incorporated herein by reference, or a cyclofeeder as described in U.S. Pat. No. 5,039,227, incorporated herein by reference. The oil sand slurry in the pump box 14 is then directly pumped to the conditioning pipeline 20 where the oil sand slurry is further conditioned.

Optionally, air and flood (dilution) water 30 is added to the conditioned slurry prior to feeding the slurry to primary separation vessel 40 ("PSV"), where separate layers of primary bitumen froth, middlings and sand tailings are formed. In one embodiment, the PSV may be of the deep cone type (e.g., typically where the angle of cone is about 55° to about 65°). The middlings may be further treated, for example, in a bank of flotation cells 60, for additional bitumen recovery, or in any other secondary recovery circuit as known in the art such as a secondary separation vessel ("SSV"), A portion of the primary bitumen froth 45 is continuously withdrawn from the PSV 40 and recycled upstream of the PSV. In one embodiment shown in FIG. 2, the portion of primary bitumen froth 45 is recycled to the pump box 14 through line 70 to be added to the slurry as it enters pump box. In another embodiment, the portion of primary bitumen froth 45 can be added directly to mix box 11 via line 50. In yet another embodiment, the portion of primary bitumen froth 45 can be added to one or more points on the conditioning pipeline 20 via line 80. In yet another embodiment, the portion of primary bitumen froth 45 can be added to the oil sand slurry after pipeline conditioning but prior to dilution with flood water 30 and gravity separation in PSV 40.

In one embodiment, the primary bitumen froth 55 produced in PSV 40 is steam deaerated in deaerator 42 to produced deaerated primary bitumen froth for further upgrading and the portion of primary bitumen froth to be recycled is taken from deaerator 42 (deaerated primary bitumen froth 95) rather than directly from PSV 40. Thus, deaerated primary bitumen froth 95 is recycled upstream of the PSV to the same steps as the aerated primary bitumen froth.

Figure 3A:
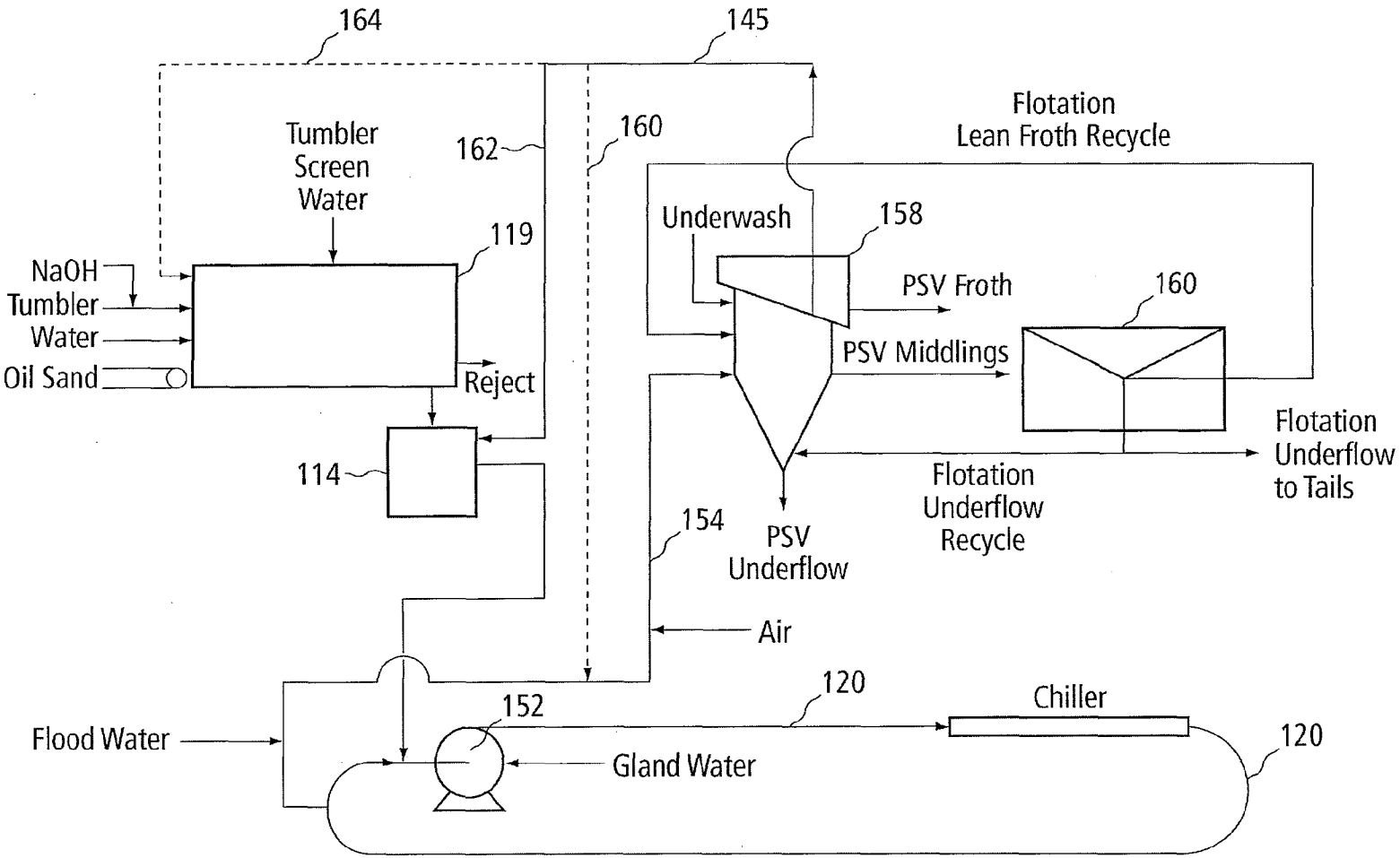
FIGS. 3*a* and 3*b* are schematics of the pilot plant used in connection with the development of the invention.

A schematic of the pilot plant used in Example 1 is shown in FIG. 3*a*. Oil sand, process (tumbler) water and, optionally, caustic (NaOH) are added to tumbler 119 where the oil sand is mixed with the water to form a slurry. Residence time of the slurry in the tumbler is generally around 2.0 minutes. The slurry is then screened through reject screen (not shown) having 5/16" square openings and rejects, i.e. oil sand lumps, greater than 5/16" are discarded.

The slurry is then transferred to an agitated pump box or mixing tank 114 to keep the slurry in suspension. Residence time of the slurry in the agitated pumpbox or mixing tank 114 is about 5 minutes. Slurry is then pumped via Moyno pump 152 through a coriolis mass flow meter (not shown) to conditioning pipeline loop 120 comprised of 4-inch pipe where the slurry undergoes conditioning. Pipeline loop 120 is approximately 40 meters in length and was designed to provide a mean residence time of approximately 5 minutes. Thus, the total residence time of the oil sand slurry in the tumbler, the agitated pumpbox or mixing tank, and the pipeline is about 12 minutes.

After leaving the pipeline loop 120, the conditioned slurry is flooded (diluted) with flood water and additional air may be added to the diluted slurry in slurry pipeline 154 which leads to the feedwell (not shown) of primary separation vessel (PSV) 140. The slurry is then fed into PSV 140 where it separates into separate layers of primary bitumen froth, middlings and sand tailings.

Froth underwash water is added to PSV 140 at a point beneath the layer of bitumen froth that forms. Separated bitumen froth overflows into launder 158 and is removed into a separate froth weigh tank (not shown). This bitumen froth from the PSV is referred to as primary bitumen froth.

Middlings, comprising water, bitumen and solids that collect in the mid-section of the PSV 140, are removed to one or more secondary flotation cells 160, each having impellers, to produce lean bitumen flotation froth. This lean froth is then recycled back into PSV 140 for recovery as primary bitumen froth.

For the froth recycle tests discussed below, baffles were installed in the PSV froth launder 158 to split the froth in the desired proportions for recycle. A portion (16% or 33%) of the primary bitumen froth is withdrawn from the PSV froth launder 158 via line 145 and recycled via line 160 or 162 either to the slurry line 154 after the conditioning pipeline loop 120 and flood water addition (but before the pipeline aerator) or the slurry preparation unit mix tank 114, respectively. In addition, primary bitumen froth could be added directly to the tumbler via line 164.

Figure 3B:
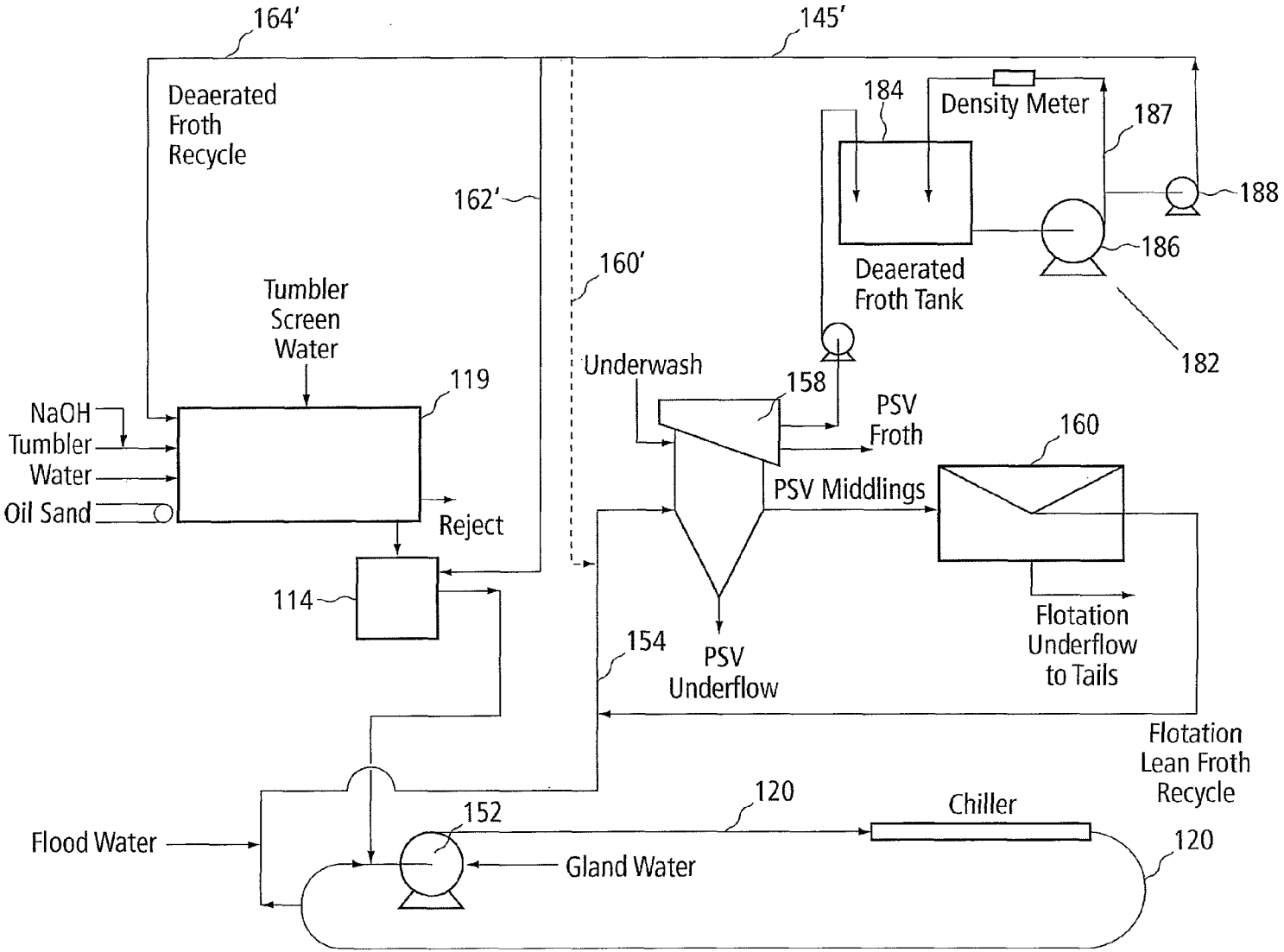

A schematic of the pilot plant used in Examples 2 and 3 is shown in FIG. 3*b*, which is essentially the same as the schematic in FIG. 3*a* except a primary bitumen froth deaeration system 182 has been added. For the froth recycle tests discussed below, baffles were installed in the PSV froth launder 158 to split the froth in the desired proportions for deaeration and recycle.

The primary bitumen froth deaeration system 182 comprises deaerated froth tank 184, which was cylindrical having a diameter of 43.3 inches and a height of 54 inches. Normal froth level in the tank 184 was 20 inches from the bottom. The tank 184 was equipped with four baffles, each 2 inches wide by 33 inches long and spaced 1 inch away from the wall. The tank 184 was stirred with a 12 inch diameter, three-blade marine impellor located 5 inches off the bottom of the tank. The impellor was on a 1.25 inch diameter shaft, and was stirred with a 3 horsepower motor. Impellor speed was initially investigated, then set at 150 RPM for testing.

The deaerated froth tank 184 was equipped with a heating jacket to maintain froth temperature, and a thermocouple to measure the froth temperature. Recirculation pump 186 on the deaerated froth tank 184 was a Moyno 1L10 model, equipped with a 15 Hp motor. Recirculated froth density was measured with a nuclear density meter. The deaerated froth discharge was pumped from the recycle line 187 through a new 3L2 Moyno pump 188 to the selected discharge destination via line 145'.

A portion (16%, 33% or 50%) of the primary bitumen froth is withdrawn from the PSV froth launder 158, deaerated in primary bitumen froth deaeration system 182 and then the deaerated bitumen froth is recycled via line 145' to the tumbler 119 (line 164') or mix tank 114 (line 162'), respectively. The deaerated bitumen froth could also be added to the slurry line 154 via line 160' after the conditioning pipeline loop 120 and flood water addition.

EXAMPLE 1

The following are the data pertaining to a pilot plant run using the pilot plant as shown in FIG. 3 carried out on oil sand sample comprising 10.1 wt % bitumen and 27 wt % fines (<44 μm) using the LEE process where operating temperatures were maintained at about 35° C.:

TABLE 1

| Percent PSV Froth Recycle, % | 0 | 16 | 33 | 16 | 33 | 16 | 33 |
|---|---|---|---|---|---|---|---|
| Water/Froth Recycle (1:1 Weight Ratio) | N/A | On | On | Off | Off | On | On |
| PSV Froth Recycle Location | N/A | Mix Tank | Mix Tank | Mix Tank | Mix Tank | Pipeline | Pipeline |
| Bitumen Recovery (Overall), % | 72.9* | 80.2 | 90.2 | 78.2 | 91.2 | 83.4 | 85.2 |
| Bitumen Recovery (Rejects free), % | 74.5* | 81.9 | 91.5 | 79.6 | 92.4 | 85.1 | 87.1 |
| PSV Froth Bitumen, wt % | 54.8* | 48.0 | 54.2 | 54.8 | 57.8 | 51.3 | 50.1 |
| PSV Froth Solids, wt % | 15.4* | 13.3 | 13.2 | 14.3 | 15.0 | 14.6 | 14.9 |
| PSV Middlings Bitumen, wt % | 6.6* | 6.9 | 6.1 | 7.2 | 1.8 | 4.9 | 4.9 |
| PSV Tailings Bitumen, wt % | 1.6* | 1.5 | 0.6 | 1.6 | 0.6 | 0.8 | 0.9 |
| Flotation Unit Bitumen Recovery, % | 96.1* | 95.7 | 96.3 | 96.0 | 88.0 | 94.5 | 94.9 |
| Flotation Underflow Bitumen, wt % | 0.31* | 0.36 | 0.27 | 0.34 | 0.24 | 0.32 | 0.30 |

*average of three separate runs

The conditions tested included PSV froth recycle to slurry preparation unit (mix tank) with and without water addition, and PSV froth recycle to slurry line, after the pipeline loop and before the aerator with water addition. Recycling 33% of the PSV froth to the slurry preparation unit (mix tank) improved bitumen recovery from approximately 73% to approximately 91% when processing oil sand with 10.1% grade and 27% fines. However, recycling only 16% of the PSV froth to slurry preparation unit only showed a slight improvement in bitumen recovery. Recycle of 16% or 33% of the PSV froth to the flooded slurry in the hydrotransport line (conditioning pipeline) before the PSV also showed slight improvement of bitumen recovery. Addition of process water to the recycled PSV froth did not significantly affect process performance.

EXAMPLE 2

The oil sands used for the following experiments comprised 8.8 wt % bitumen and 51 wt % fines (solids less than 44 μm) and a warm slurry extraction process was used, where operating temperatures were maintained at about 50° C. Table 2 summarizes the results of bitumen recoveries using primary bitumen froth recycle via the deaerated froth tank (DFT) to the tumbler feed (TF).

TABLE 2

| Percent PSV Froth Recycle, % | N/A | 16 | 33 | 50 | 50 |
|---|---|---|---|---|---|
| PSV Froth Directed to: | N/A | DFT | DFT | DFT | DFT |
| DFT Discharge Directed to: | N/A | TF | TF | TF | TF |
| Bitumen Recovery, % | 87.8* | 92.7 | 93.1 | 95.3 | 93.4 |

TABLE 2-continued

| | | | | | |
|---|---|---|---|---|---|
| PSV Froth Bitumen, wt % | 51.8* | 48.9 | 48.4 | 46.5 | 47.2 |
| PSV Froth Solids, wt % | 11.6* | 12.7 | 19.3 | 22.2 | 22.4 |
| PSV Middlings Bitumen, wt % | 1.90* | 0.72 | 0.43 | 0.49 | 0.28 |
| PSV Tailings Bitumen, wt % | 0.49* | 0.25 | 0.20 | 0.09 | 0.14 |
| Flotation Bitumen Recovery, % | 95.2* | 88.9 | 87.5 | 86.8 | 75.5 |
| Flotation Underflow Bitumen, wt % | 0.11* | 0.10 | 0.07 | 0.08 | 0.08 |

*average of base case runs

It can be seen from the data in Table 2 that recycling of increasing amounts of deaerated PSV froth to the slurry preparation unit (tumbler feed) of 16%, 33% and 50% resulted in a steady increase in bitumen recovery from 87.8% (base case, with no primary froth recycle) to 92.7%, 93.1% and 95.3% (93.4%), respectively.

EXAMPLE 3

The oil sands used in the following experiments comprised 8.8 wt % bitumen and 51 wt % fines (solids less than 44 μm). A warm slurry extraction process was used where operating temperatures were maintained at about 50° C. Table 3 summarizes the results of bitumen recoveries using primary bitumen froth recycle via the deaerated froth tank (DFT) to the mix tank (MT).

TABLE 3

| Percent PSV Froth Recycle, % | N/A | 16 | 16 | 33 | 33 | 50 |
|---|---|---|---|---|---|---|
| PSV Froth Directed to: | N/A | DFT | DFT | DFT | DFT | DFT |
| DFT Discharge Directed to: | N/A | MT | MT | MT | MT | MT |
| Bitumen Recovery, % | 87.8* | 92.5 | 92.2 | 94.5 | 94.4 | 95.2 |
| PSV Froth Bitumen, wt % | 51.8* | 58.7 | 57.3 | 48.4 | 46.4 | 48.5 |
| PSV Froth Solids, wt % | 11.6* | 14.7 | 15.8 | 19.2 | 19.4 | 20.5 |
| PSV Middlings Bitumen, wt % | 1.90* | 0.59 | 0.41 | 0.33 | 0.38 | 0.26 |
| PSV Tailings Bitumen, wt % | 0.49* | 0.25 | 0.22 | 0.13 | 0.07 | 0.11 |
| Flotation Bitumen Recovery, % | 95.2* | 86.3 | 77.1 | 89.8 | 87.2 | 76.1 |
| Flotation Underflow Bitumen, wt % | 0.11* | 0.10 | 0.12 | 0.04 | 0.06 | 0.08 |

*average of base case runs

It can be seen from Table 3 that recycling of increasing amounts of deaerated PSV froth to the slurry preparation unit (mix tank) of 16%, 33% and 50% resulted in a steady increase in bitumen recovery from 87.8% (base case, with no primary froth recycle) to 92.5% (92.2%), 94.5% (94.4%) and 95.2%, respectively.

It is understood that there may be more than one oil sand slurry process line and PSV operating at the same time. Thus, the portion of primary bitumen froth or deaerated primary bitumen froth derived from any PSV can be recycled back to any one or more than one of several process lines that may be operating simultaneously. For example, primary bitumen froth produced from one plant/process line could be added to slurry pump boxes or tumblers in another plant/process line, for example, where lower grade, higher fines oil sand is being mined.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A process for extracting bitumen from oil sand, comprising:

mixing oil sand with process water to produce an oil sand slurry containing bitumen, sand, water and entrained air;

conditioning the oil sand slurry;

optionally flooding the conditioned oil sand slurry with flood water to dilute the slurry if required;

introducing the slurry into a primary separation vessel wherein separate layers of primary bitumen froth, middlings and sand tailings are formed;

removing a portion of the primary bitumen froth from the primary separation vessel and recycling the portion of primary bitumen froth to that step of the process upstream of the primary separation vessel to join and mix with the feed stream moving to the primary separation vessel; and thereafter retaining said feed stream in said primary separation vessel to produce primary bitumen froth.

2. The process as set forth in claim 1 further comprising deaerating the portion of primary bitumen froth removed from the primary separation vessel prior to upstream recycling.

3. The process as set forth in claim 1 wherein the portion of primary bitumen froth is added at the conditioning step.

4. The process as set forth in claim 3 wherein the conditioning step takes place in a conditioning pipeline.

5. The process as set forth in claim 3 wherein the conditioning step takes place in a rotary tumbler.

6. The process as set forth in claim 1 wherein mixing and conditioning of the oil sand slurry occurs simultaneously.

7. The process as set forth in claim 1 wherein the portion of primary bitumen froth is added at the mixing step.

8. The process as set forth in claim 1 wherein the mixing takes place in a slurry preparation unit comprising a mixer and a pump box for receiving the oil sand/water mixture.

9. The process as set forth in claim 1 wherein the mixing takes place in a slurry preparation unit comprising a mixer and a pump box for receiving the oil sand/water mixture and the conditioning takes place in a conditioning pipeline.

10. The process as set forth in claim 8 wherein the portion of primary bitumen froth is added to the pump box.

11. The process as set forth in claim 8 wherein the portion of primary bitumen froth is added to the mixer.

12. The process as set forth in claim 1 wherein the portion of primary bitumen froth is added after conditioning but prior to introducing the slurry into the primary separation vessel.

13. The process as set forth in claim 1 wherein the portion of primary bitumen froth is up to about 20% of the froth produced in the primary separation vessel.

14. The process as set forth in claim 1 wherein the portion of primary bitumen froth is up to about 50% of the froth produced in the primary separation vessel.

15. The process as set forth in claim 1 wherein the portion of primary bitumen froth is at least between about 10% to about 50% of the froth produced in the primary separation vessel.

16. The process as set forth in claim 1 wherein the process water is at a temperature of between about 20° C. and about 95° C.

17. The process as set forth in claim 16 wherein the process water is at a temperature of between about 20° C. and about 45° C.

18. The process as set forth in claim 1 wherein the oil sand slurry in the primary separation vessel is maintained at a temperature of between about 50° C. and about 25° C.

* * * * *